United States Patent [19]

Metzger

[11] 4,395,941

[45] Aug. 2, 1983

[54] PAPER PACKER AND FILE

[76] Inventor: Courtney A. Metzger, 4072 Hominy Ridge Rd., Springfield, Ohio 45302

[21] Appl. No.: 289,973

[22] Filed: Aug. 4, 1981

[51] Int. Cl.[3] ..... B65B 13/00

[52] U.S. Cl. ..... 100/34

[58] Field of Search ..... 100/1, 34; 211/50; 53/390; D6/184

[56] References Cited

U.S. PATENT DOCUMENTS

| | | | |
|---|---|---|---|
| D. 159,165 | 6/1950 | Rippe | 100/34 UX |
| 2,747,498 | 5/1956 | Bellar | 100/34 |
| 3,145,646 | 8/1964 | Levy | 100/34 |
| 3,382,794 | 5/1968 | Lindholm | 100/34 |
| 3,498,214 | 3/1970 | Bailey | 100/34 |
| 3,933,088 | 1/1976 | Pessagno | 100/34 |
| 3,964,381 | 6/1976 | Coenen | 100/34 |
| 4,167,903 | 9/1979 | Lasher | 100/34 |

FOREIGN PATENT DOCUMENTS

| | | | |
|---|---|---|---|
| 611219 | 5/1979 | Switzerland | 100/34 |

*Primary Examiner*—Billy J. Wilhite

*Attorney, Agent, or Firm*—Gregory A. Stobbs

[57] ABSTRACT

A newspaper storage and baling device which features upright arms, forming a basket, to keep newspapers neatly stacked. The device includes a readily dispensible supply of twine in two bundles for baling the stacked newspapers.

4 Claims, 4 Drawing Figures

PAPER PACKER AND FILE

BACKGROUND OF THE INVENTION

1. Field of the Invention

This invention relates to a device for storing and bundling newspapers or the like.

2. Description of the Prior Art

Americans spend about four billion dollars a year to discard 140 million tons of solid waste, much of which is recyclable. It is estimated that twenty-five percent of this waste is newspaper and other paper periodicals.

Others have suggested apparatuses in which such paper waste could be stored and bundled for recycling. See for example, U.S. Pat. No. 3,382,794 to Lindholm; U.S. Pat. No. 3,498,214 to Bailey; U.S. Pat. No. 3,964,381 to Coenen, and U.S. Pat. No. 4,167,903 to Lasher.

However, none of these apparatuses are both inexpensive to manufacture and easy to use.

SUMMARY OF THE INVENTION

The apparatus of this invention comprises a pair of rails, spaced apart, to form a base for supporting a stack of newspapers thereon. Three pairs of U-shaped cradles are attached to the base to form upright members which laterally support the stack of newspapers. Also provided is an axle, between the rails, onto which two bundles of twine are wound for readily baling the stacked newspaper.

It is a principal object of this invention to provide a convenient receptacle for storing and bailing newspapers and the like.

Another object of this invention is to provide a handy and orderly reference file for the daily newspaper or other periodicals.

Yet another object is to decrease the fire hazzard and litter problem associated with loose paper periodicals.

For a further and more detailed understanding of this invention, its objects, and its advantages, reference is made to the following description and the accompanying drawings.

DESCRIPTION OF THE PREFERRED EMBODIMENT OF THE INVENTION

Figure 1:
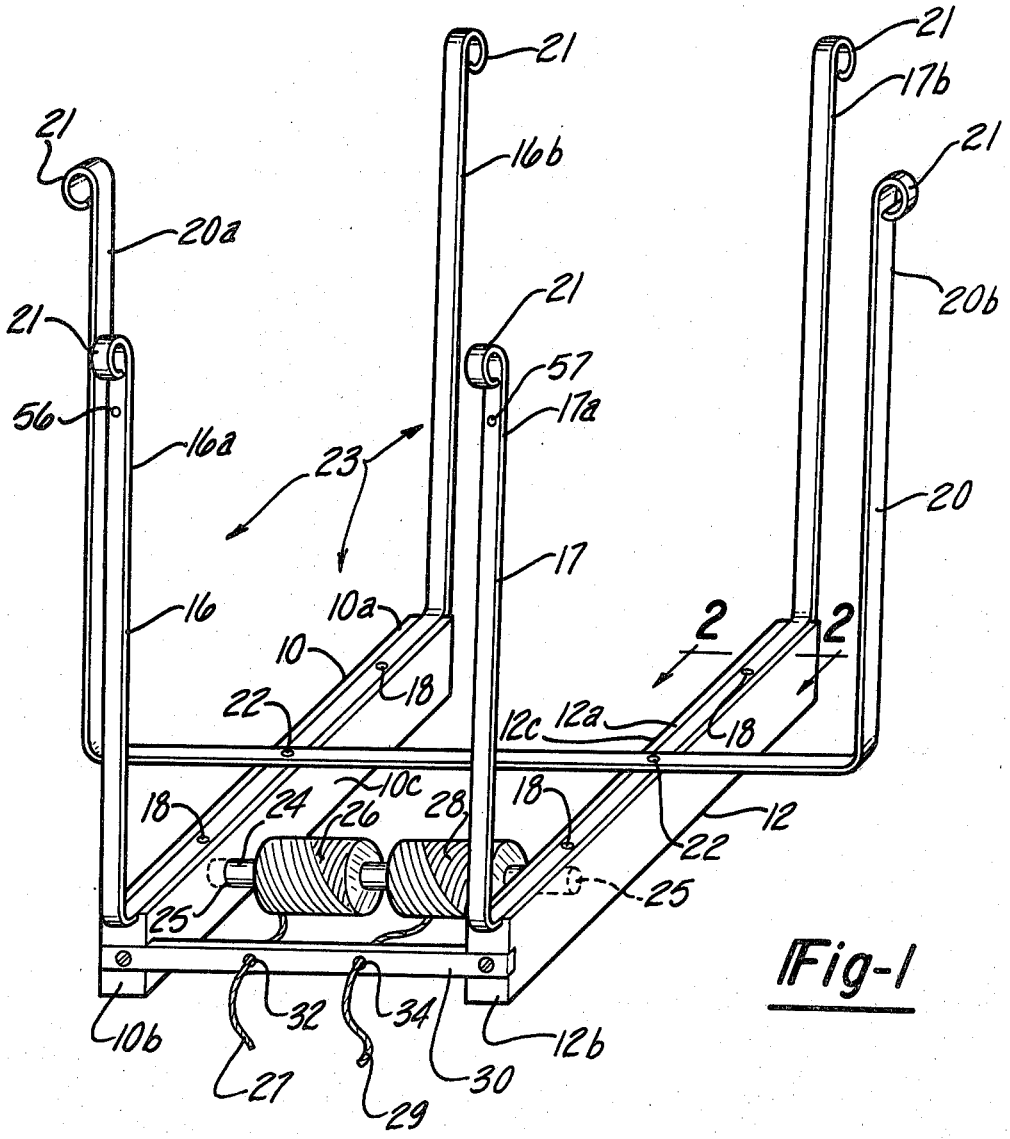
FIG. 1 is a perspective view of the apparatus which embodies the principles of the invention.
Figure 2:
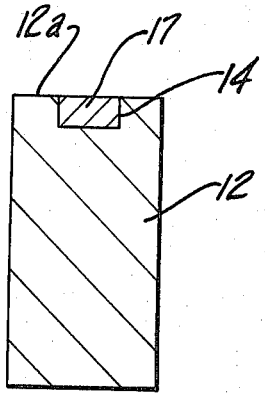
FIG. 2 is a sectional view taken along the line 2—2 of FIG. 1 and showing the relationship between a rectangular groove and its interfitting cradle.

Referring to FIG. 1 of the drawings, the present newspaper storage and baling apparatus comprises a pair of elongated rails of rectangular cross section, 10 and 12, arranged in a spaced-apart, parallel relation with one another to form a base. The rails each have uppermost faces 10*a* and 12*a*, front end faces 10*b* and 12*b*, and inside faces 10*c* and 12*c*. A rectangular groove 14, as shown in FIG. 2, is routed along the length of each rail in the uppermost faces, 10*a* and 12*a*, thereof.

Two U-shaped, upwardly extending cradles 16 and 17 are respectively seated in the groove 14 of each rail 10 and 12, and secured with screws 18 or glue.

A third U-shaped, upwardly extending cradle 20 is arranged to orthogonally cross cradles 16 and 17 at their midpoints, and is secured to the rails 10 and 12 with screws 22.

It will be seen that the upwardly extending cradles 16, 17, and 20 comprise a plurality of upright members 16*a*, 16*b*, 17*a*, 17*b*, 20*a*, and 20*b*. The ends of each such upright member are formed is the shape of, or provided with loops 21, as shown in FIG. 1 and members 16*a* and 17*a* are also provided with eyes 56 and 57. The upright members and rails thus define a basket-like receptacle 23.

Referring still to FIG. 1, the present invention also comprises an axle 24 journaled in a pair of circular holes 25 located on the inside faces 10*c* and 12*c*. In the preferred embodiment, the axle 24 is further situated toward the front end face 10*b* and front end face 12*b* of rails 10 and 12.

Upon the axle 24 are wound two bundles of twine 26 and 28, each bundle having a free end portion of twine 27 and 29, respectively.

A brace 30 is attached to the front end faces 10*b* and 12*b* of rails 10 and 12, and has a pair of twine guide holes 32 and 34.

OPERATION

In operation the free ends of twine 27 and 29 are laced through guide holes 32 and 34, respectively, thence through the eyes 56 and 57 of upright members 16*a* and 17*a*, respectively. Next, the free ends are pulled to unroll an amount of slack twine from bundles 26 and 28, the slack being roughly equal in length to the running length of braces 16 or 20, as if traced along the braces' entire U-shape. Finally, the free ends 27 and 29 are tied as with square knots to the loops 21 of upright members 16*b* and 17*b*, respecitvely.

Figure 3:
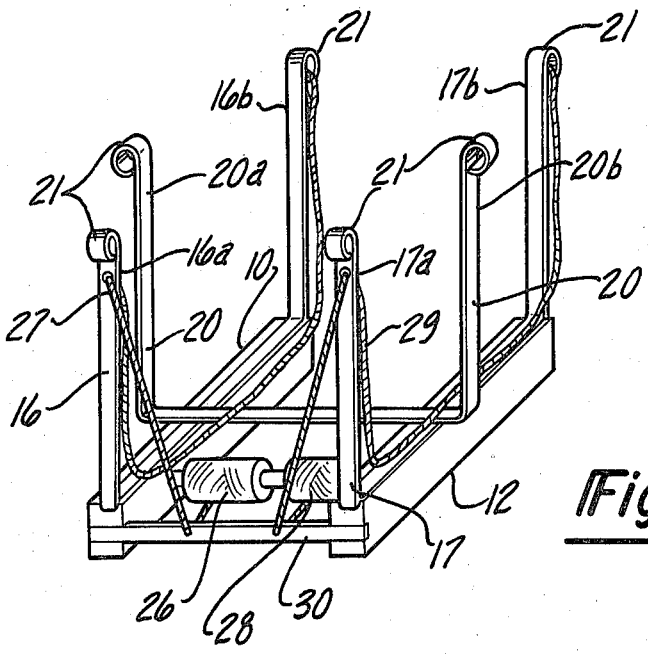
FIG. 3 is a perspective view showing twine laced and ready for use.
Figure 4:
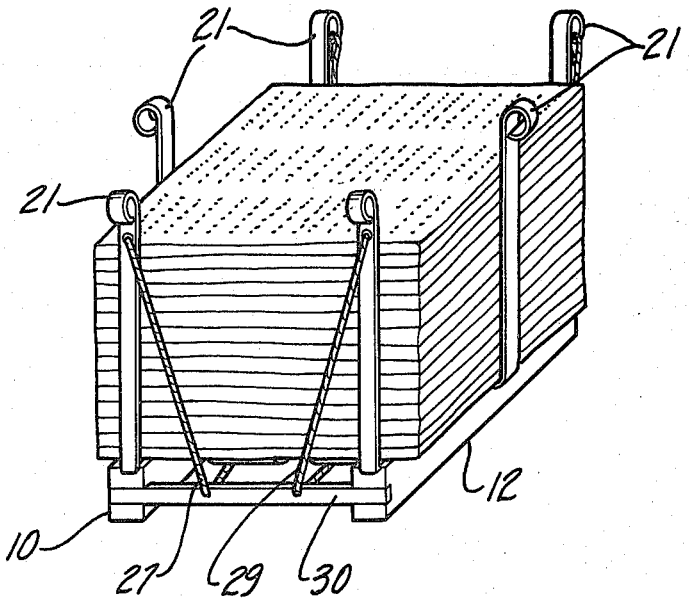
FIG. 4 is a perspective view illustrating a use of the apparatus.

By referring th FIG. 3 it will be seen that the twine, now laced and ready for use, assumes a U-shaped configuration, generally contiguous with braces 16 and 17, due to the effect of gravity upon the suspended twine.

When a newspaper or other periodical is to be stored or discarded, it is simply dropped into the basket-like receptacle 23. As additional newspapers are discarded, a stack is formed, being laterally supported by the upright members 16*a*, 16*b*, 17*a*, 17*b*, 20*a*, and 20*b*. After a sufficient stack has accumulated, the free ends of twine are untied from loops 21 of upright members 16*b* and 17*b*. The free ends are then pulled to unroll additional twine to circumscribe the stack. The free ends are then tied to the circumscribing portion of the twine to bind the stack.

Once the stack has been bundled together and bound tightly, it may be easily lifted from the basket-like receptacle for disposal or storage.

While a presently preferred embodiment of this invention has been illustrated and described in detail, it will be understood that modifications as to details of construction and design are possible without departing from the spirit of the invention or the scope of the following claims.

I claim:

1. A newspaper storage and baling apparatus comprising a base for supporting a stack of newspapers thereon, a plurality of upright members attached to said base for laterally supporting said stack of newspapers, an axle carried by said base, a supply of twine carried by said axle and wound in a plurality of separate individual bundles each bundle having a free end for tying around said stack of newspapers, a twine holding means associated with an upright member for suspending the free ends of said twine, thereby making said twine accessible for baling said stack of newspapers, wherein a first pair of said upright members comprises a substantially U-shaped cradle and said base comprises two rails secured in spaced relation to each other by said U-shaped cradle and said axle is horizontally disposed between said rails.

2. A newspaper storage and baling apparatus according to claim 1, wherein a second pair of said upright members comprises a substantially U-shaped cradle.

3. A newspaper storage and baling apparatus according to claim 1, wherein said twine holding means comprises a loop means associated with said upright member.

4. A newspaper storage and baling apparatus according to claim 1, wherein said twine holding means comprises a loop means associated with said upright member and further comprises a brace disposed between said rails having a guide means through which said twine may be threaded.

* * * * *